US006864443B1

(12) United States Patent
Bruchmann

(10) Patent No.: US 6,864,443 B1
(45) Date of Patent: Mar. 8, 2005

(54) MULTIPOLAR CIRCUIT-PROTECTION ASSEMBLY FOR A COLLECTOR RAIL SYSTEM

(76) Inventor: Klaus Bruchmann, Am Oelberg 7a, D-96450 Coburg (DE)

( * ) Notice: Subject to any disclaimer, the term of this patent is extended or adjusted under 35 U.S.C. 154(b) by 115 days.

(21) Appl. No.: 10/031,831

(22) PCT Filed: Aug. 2, 2000

(86) PCT No.: PCT/EP00/07484

§ 371 (c)(1),
(2), (4) Date: May 15, 2002

(87) PCT Pub. No.: WO01/11642

PCT Pub. Date: Feb. 15, 2001

(30) Foreign Application Priority Data

Aug. 5, 1999 (DE) ..... 199 37 017
Aug. 5, 1999 (DE) ..... 299 13 698 U

(51) Int. Cl.[7] ..... H01H 9/20

(52) U.S. Cl. ..... 200/50.01; 200/50.28; 200/43.11; 335/131

(58) Field of Search ..... 200/50.01, 50.04–50.07, 200/50.28, 50.3, 43.11, 43.01, 50.32; 335/131, 132

(56) References Cited

U.S. PATENT DOCUMENTS 1,556,823 A 10/1925 Holmes
4,724,512 A * 2/1988 Bischof et al. ..... 361/642
4,789,919 A * 12/1988 Cox et al. ..... 361/609
5,814,777 A * 9/1998 Green et al. ..... 200/50.33
5,911,318 A * 6/1999 Miyazaki ..... 200/556
6,225,581 B1 * 5/2001 Gerbert-Gaillard et al. ..... 200/50.01
6,252,186 B1 * 6/2001 Liebetruth et al. ..... 200/43.01

FOREIGN PATENT DOCUMENTS

| | | | |
|---|---|---|---|
| DE | G 88 02 457.1 | U1 | 6/1988 |
| DE | 42 07 156 C | E2 | 12/1993 |
| DE | G 94 03 039.1 | U1 | 9/1994 |
| DE | 197 34 235 | A1 | 2/1999 |
| EP | 0 418 206 | A3 | 3/1991 |
| EP | 0 418 206 | A2 | 3/1991 |
| WO | WO 86/06221 | A1 | 10/1986 |

OTHER PUBLICATIONS

English language version of International Search Report for PCT/EP00/07484.
English language version of International Preliminary Examination Report for PCT/EP00/07484.

* cited by examiner

*Primary Examiner*—Kyung Lee
(74) *Attorney, Agent, or Firm*—Wood, Phillips, Katz, Clark & Mortimer

(57) ABSTRACT

The invention relates to a multipole fused switch arrangement for busbar systems having at least two fused switch units (10) which each holds a fuse link (20), with the fused switch units (10) having a mounting and contact apparatus (11) for a busbar, and having a switching apparatus for closing and interrupting the circuit of all the switched fuse units, with the fused switch arrangement comprising a combined switching and blocking apparatus (30), having a switching lever (40), an operating arrangement (60), a blocking apparatus (70) for each fused switch unit (10), and a locking apparatus (80).

14 Claims, 4 Drawing Sheets

MULTIPOLAR CIRCUIT-PROTECTION ASSEMBLY FOR A COLLECTOR RAIL SYSTEM

This application is an application filed under 35 U.S.C. Sec. 371 as a national stage of international application PCT/EP00/07484, which was filed Aug. 2, 2000.

TECHNICAL FIELD

The invention relates to a multipole fused switch arrangement for busbar systems having at least two fused switch units which each holds a fuse link, with the fused switch units having a mounting and contact apparatus for a busbar, and having a switching apparatus for closing and interrupting the circuit of all the switched fuse units.

BACKGROUND OF THE INVENTION

Such fused switch arrangements are used in particular for protecting three-phase circuits, in which case three-pole fused switch arrangements are required.

Since such fused switch arrangements are also operated by those not skilled in the art, it has frequently been found to be a problem that incorrect operations even on the fused switch arrangement have led to damage to the appliances.

SUMMARY OF THE INVENTION

Accordingly, one object of the invention is to provide a multipole fused switch arrangement which is simple to operate and which minimizes the risk of incorrect operations by untrained personnel.

The object is achieved by a multipole fused switch arrangement according to the invention.

According to the invention, the fused switch arrangement comprises a combined switching and blocking apparatus.

The combined switching and blocking apparatus has a switching lever, which can be switched to and fro between a switched-on position and a switched-off position, an operating arrangement for switching switching links of the fused switch units, in which case the operating apparatus can be switched to and fro between a contact position and an interrupted position, a blocking apparatus for each fused switch unit for blocking the operating arrangement in the interrupted position, and a locking apparatus for locking the fuse link in an operating position, in which case the locking apparatus can be switched to and fro between a locked position and an isolating position.

The locking apparatus is coupled to the switching lever such that it is always in the locked position when the switching lever is in the switched-on position, and which, conversely, is in the isolating position when the switching lever is in the switched-off position. The operating arrangement is furthermore coupled to the switching lever such that it is always in the interrupted position when the switching lever is in its switched-off position. Further coupling between the operating arrangement and switching lever is possible, but not necessary.

The blocking apparatus blocks the operating arrangement in the interrupted position when one of the fuse links from the fused switch arrangement is not in its operating position, that is to say it has been completely removed from the fused switch arrangement, or has been at least partially withdrawn from its operating position.

The multipole fused switch arrangement according to the invention carries out two major protection functions. Firstly, it prevents the circuit of the fused switch arrangement from being closed via the switching links when the fuse links are not all in their operating position, and the fused switch arrangement is thus no longer in a ready to operate state. Secondly, it makes it impossible to remove fuse links when the fused switch arrangement is switched on, or to move them from their operating position, without previously having interrupted the circuit, so that the fuse links can be replaced only when no current is flowing and no voltage is applied. This double protection function reliably precludes incorrect operations and prevents damage to the elements of the fused switch arrangement, in particular of the contacts, for example as a result of switching arcs and spark flashovers.

In one preferred embodiment, the operating arrangement has a pushrod for each fused switch unit, with the pushrods being rigidly connected to one another and each pushrod resting on spring-loaded switching links via which the circuit of the fused switch unit is closed and interrupted. This ensures that all the circuits in all the fused switch units are interrupted even if only one of the pushrods is blocked in its interrupted position, since the associated fuse link is not in its operating position.

The operating arrangement can be coupled directly or indirectly to the switching lever in various ways. The coupling is preferably provided via a switching rod which is guided in a recess in the switching lever. The operating arrangement and the switching lever are coupled on only one side, that is to say only switching of the switching lever from the switched-on position to the switched-off position results in force being exerted on the operating arrangement via the switching rod, while there is no direct coupling between the switching rod and the operating arrangement when the switching lever is switched from the switched-off position to the switched-on position. Thus, although the switching lever can also be moved to the switched-on position when the operating arrangement is blocked in its interrupted position, no force is exerted, however, by the switching rod or the switching lever on the operating arrangement. This prevents loading or damage, in particular to the blocking apparatus. At the same time, this ensures that the circuit cannot be closed inadvertently by forceful operation of the switching lever while at the same time destroying the blocking apparatus.

The operating arrangement is preferably prestressed in its contact position by at least one spring apparatus, so that the operating arrangements are automatically located in their contact position when, firstly, all the fuse links are in their operating position and the blocking apparatus is in consequence not acting on the operating arrangement, and when the operating lever is in its switched-on position.

Each blocking apparatus is advantageously prestressed by a spring apparatus in a position which blocks the operating arrangement in its interrupted position, so that the operating arrangement is released only when one fuse link is in its operating position, as a result of which the blocking apparatus is moved against the force of the spring effect to a position in which the blocking apparatus and the operating arrangement do not influence one another. The blocking apparatus is automatically moved by the spring apparatus to its blocking position as soon as one fuse link is removed from its operating position, although, owing to the locking apparatus, this can occur only if the switching lever is in its switched-off position, and the operating arrangement is thus in its interrupted position.

When it is in its blocking position, the blocking apparatus advantageously engages in an opening in the operating arrangement, so that the blocking apparatus prevents any movement of the operating arrangement.

Depending on the configuration of the individual fused switch units, the fuse links are inserted directly into the fused switch unit, or fuse plugs are used to hold the fuse links in the fused switch units.

Accordingly, a locking apparatus can be provided which acts directly on the fuse link, but locking apparatuses are preferably provided which do not act directly on the fuse link, but which engage with a latching element on a fuse plug when in their locked position.

BRIEF DESCRIPTION OF THE DRAWINGS

The features and advantages of the invention will become particularly clear from the attached schematic drawings, in which.

DETAILED DESCRIPTION OF THE PREFERRED EMBODIMENT

Figure 1:
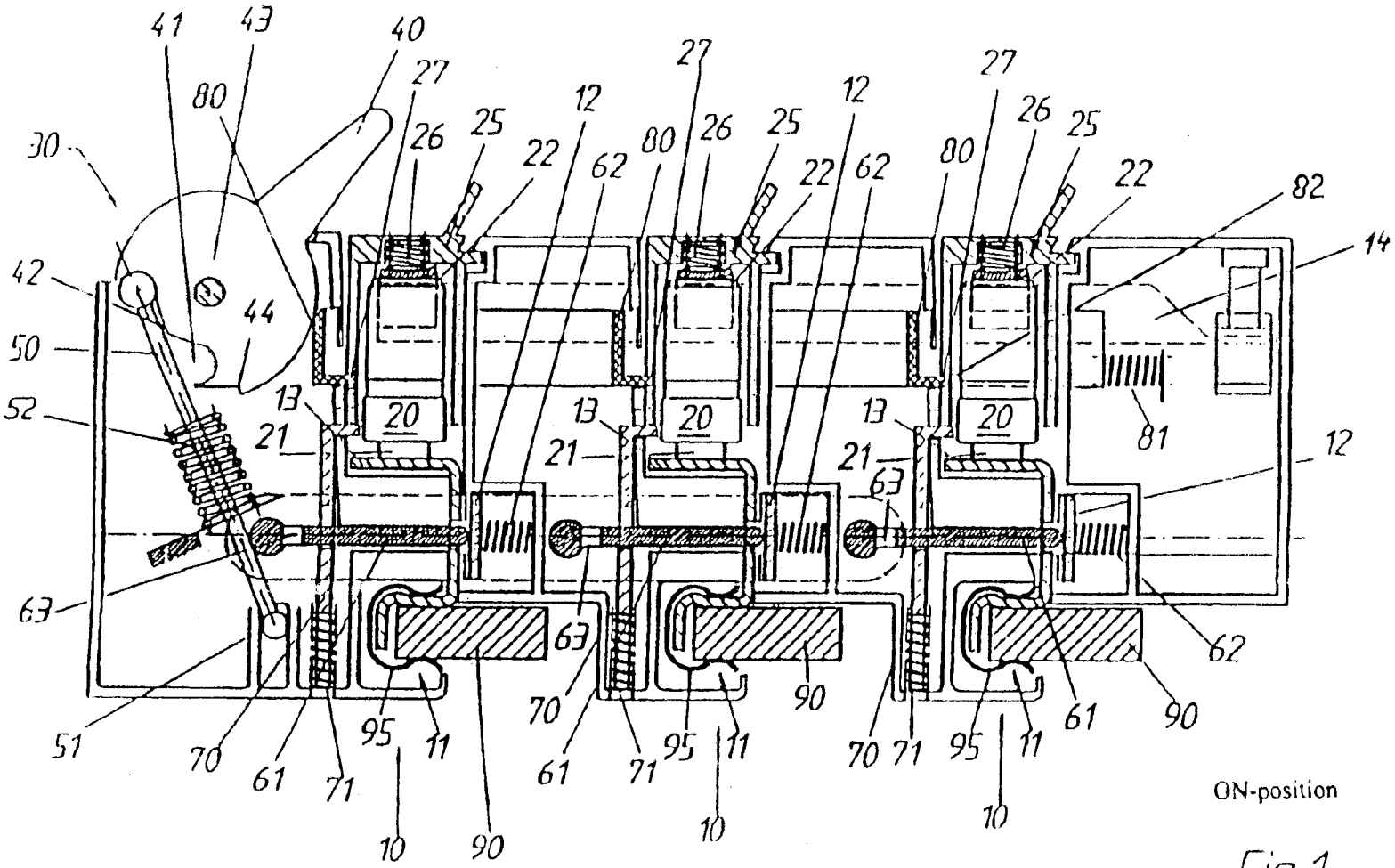
FIG. 1 shows a cross-sectional view of one embodiment of a three-pole fused switch arrangement, with the switching lever being in a switched-on position and the fused switch arrangement being ready to operate.

FIG. 1 shows a fused switch arrangement having three fused switch units 10, into each of which a fuse plug 25 with a fuse link 20 is inserted.

Each fused switch unit 10 is mounted on a busbar 90 by means of a surrounding spring 95.

The switching and blocking apparatus according to the invention comprises, in the embodiment shown in FIG. 1, a switching lever 40, a spring-loaded switching rod 50, an operating apparatus 60 which in each case comprises one pushrod 61 per fused switch unit 10, a spring-loaded blocking apparatus 70, and a likewise spring-loaded locking apparatus 80. The spring 52 of the switching rod 50 has a considerably greater spring constant than the springs 62 in the operating apparatus and the springs 81 in the locking apparatus, which have approximately the same spring constants. The springs 71 in the blocking apparatus 70 have the lowest spring constant in the switching and blocking apparatus.

When the fused switch arrangement is in the working position shown in FIG. 1, the switching lever 40 is in the switched-on position. The switching lever 40 has a recess 41, in which one end of the switching rod 50 is guided. The other end of the switching rod 50 is seated in a bearing 51 in the fused switch arrangement.

The operating arrangement 60 is prestressed in its contact position indirectly via three springs 62, which are positioned between the housing of the fused switch arrangement and switching links 12. The switching links 12 thus bridge an interruption in a bottom contact 30, which makes contact with a lower contact 21 of the fuse link 20, so that the contact is produced between the fuse link 20 and the busbar 90.

The operating arrangement 60 is in this case deflected so far in the direction of the switching rod 50 that the pushrod 61 on the left in the drawing rests on the switching rod 50.

Each upper contact 22 of the fuse link 20 makes contact with a tapping contact 14, so that the circuit is closed via the tapping contact 14, the upper contact 22 and the lower contact 21 of the fuse link 20, the bottom contact 13, the switching link 12, the extension of the interrupted bottom contact 13 and the busbar 19.

The fuse link 20 is always pressed by force from a spring 26 in the fuse plug 25 against the bottom contact 13, thus ensuring a reliable contact.

The locking apparatus is pressed by the formed-out region 43 of the switching lever 40 into an opening (which is used as a latching element 27) in the fuse plug 25, so that the fuse plug 25 is fixed, together with the fuse link 20, in its operating position. The locking apparatus 80 is formed as one part for all the fused switch units and is prestressed by means of a spring apparatus 81 against the formed-out region 43 of the switching lever 40.

Individual fused switch units and their assemblies are identical, and it should once again be mentioned that both the locking apparatus 80 and the operating arrangement 60 are formed as one part for all the fused switch units, so that the individual elements can thus move only together, and no relative movement is possible, for example between the pushrod 61. In contrast, the blocking apparatuses 70 are autonomous assemblies, which are separate from one another, in each fused switch unit 10.

Figure 2:
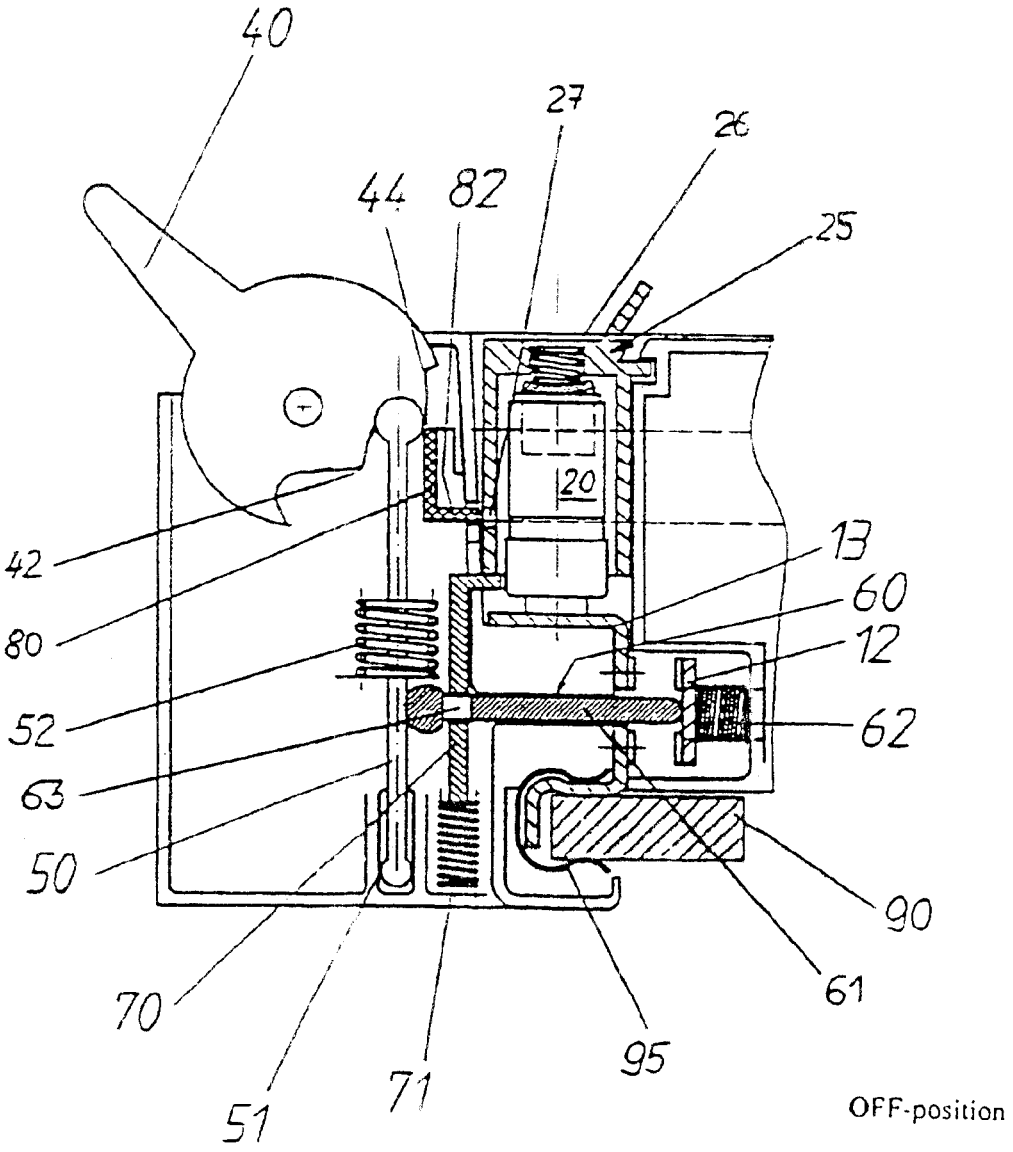
FIG. 2 shows a detail of the fused switch arrangement shown in FIG. 1, with the switching lever being in a switched-off position.
Figure 3:
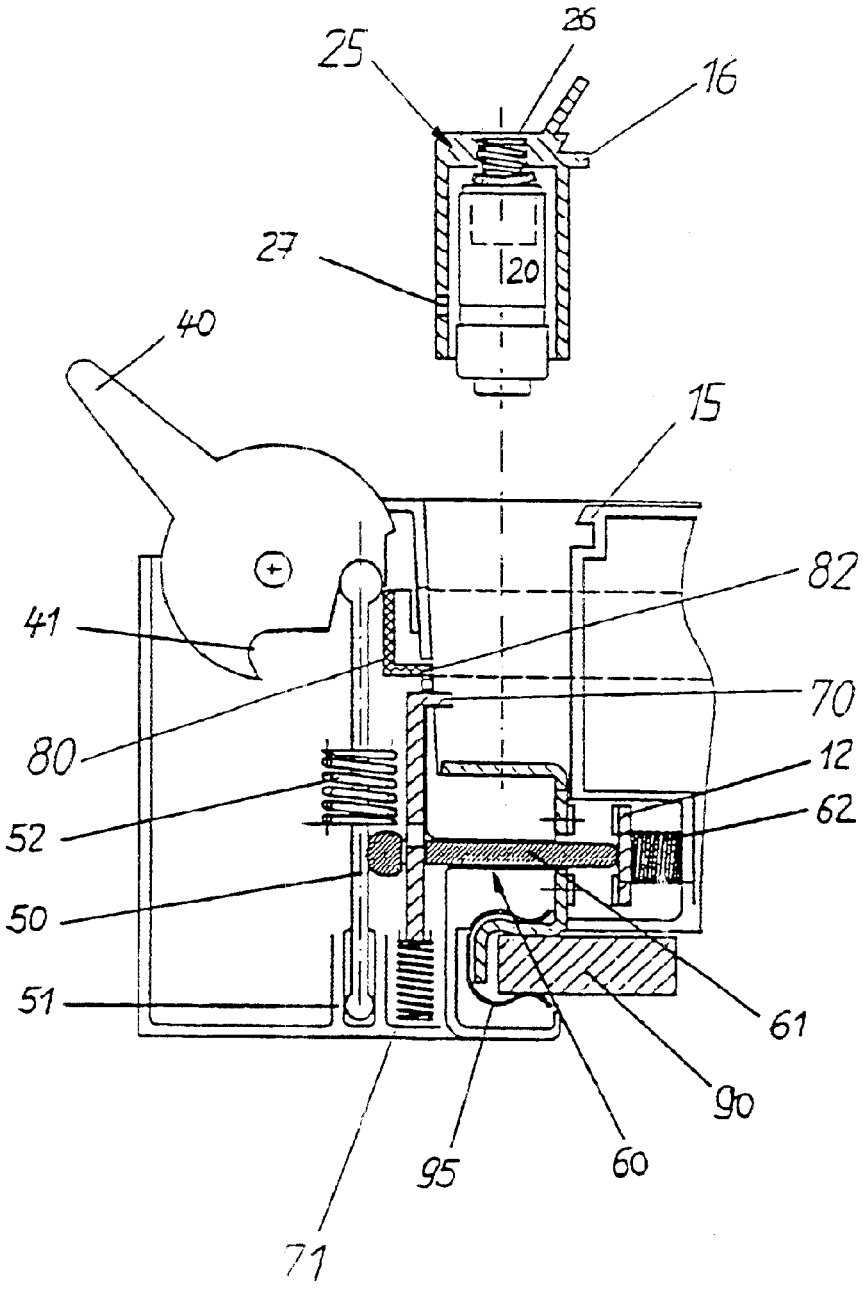
FIG. 3 shows the detail shown in FIG. 2, but with the fuse link having been removed.
Figure 4:
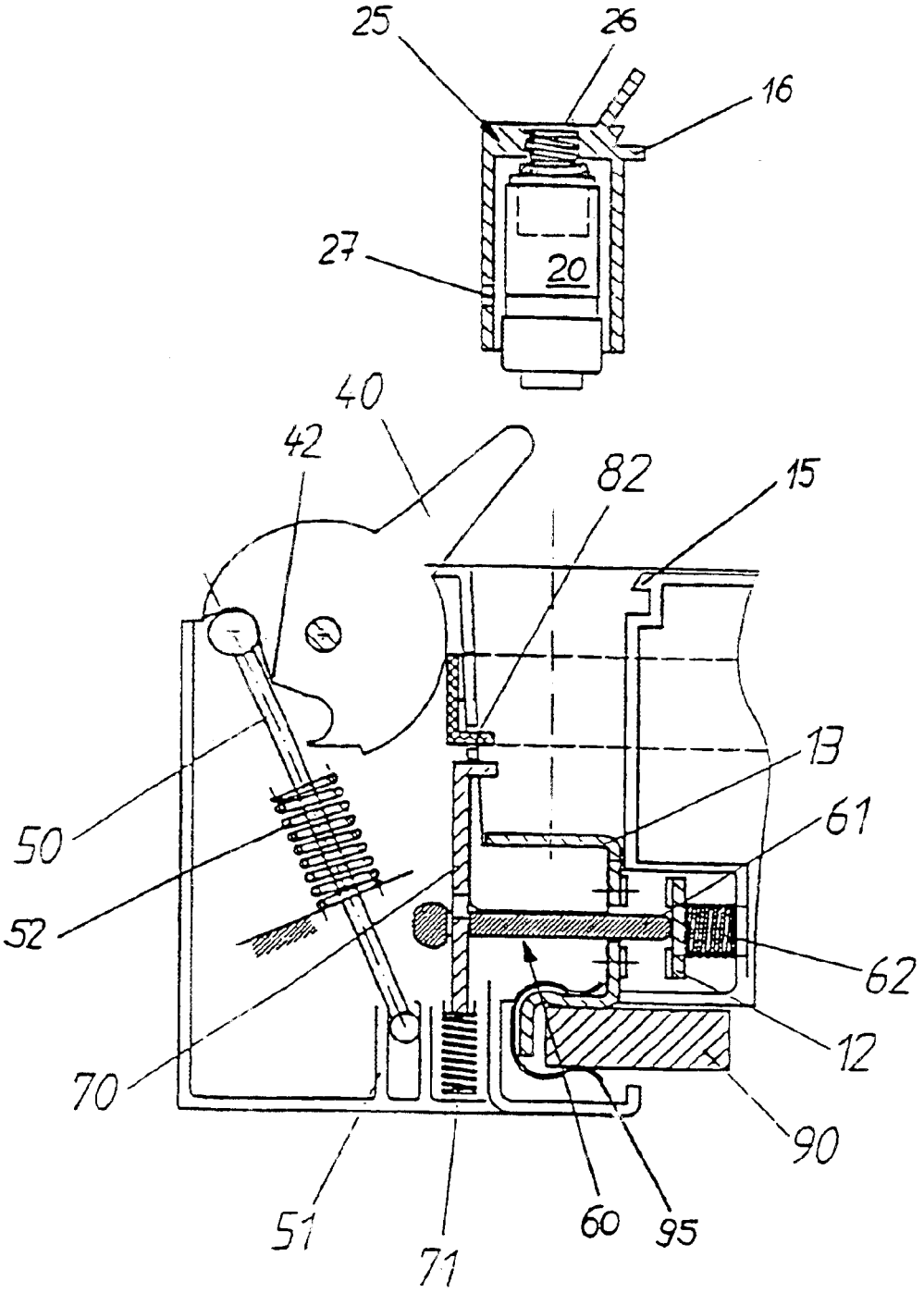
FIG. 4 shows the details shown in FIGS. 2 and 3, but with the switching lever having been removed to the switched-on position after removal of the fuse link.

The method of operation of the switching and blocking apparatus 30 according to the invention is clear from the further FIGS. 2 to 4, which, for simplicity, show only a detail of the embodiments.

In FIG. 2, the switching lever 40 has been moved from its switched-on position to its switched-off position. The locking apparatus 80, which is prestressed against the switching lever 40 by means of the spring 81, has been moved to the left in the figure, after passing over a step 44 (which is introduced in the switching lever 40) in the switching lever 40, so that the interlocking element 82 no longer engages with the opening 27 in the fuse plug 25. The fuse plug 25, together with the fuse link 20, is thus no longer locked in its operating position.

The switching of the switching lever 40 to its switched-off position results in the switching rod 50 pivoting to the right in its bearing 51 and in the recess 42, as a result of which the operating arrangement 60 is forced via the pushrod 61 to its interrupted position, in which the switching link 12 is lifted off the bottom contact 13. The circuit is thus interrupted at the bottom contact 13.

Since the fuse plug 25 is still in its operating position and presses against a protrusion on the blocking apparatus, the blocking apparatus 70 is still held in a non-blocking position against the influence of its spring apparatus 71.

Subject to the precondition that all the other fused switch units (which are not shown in FIG. 2), are in analogous positions, the switching lever 40 can be moved back to its switched-on position, as a result of which the fuse plugs 25 are automatically locked by the locking apparatus 80. Since the operating arrangement 60 is not blocked, it is pushed to the left in the drawing together with the switching link 12 by means of the spring apparatus 62, as a result of which the switching link 12 makes contact with the interrupted bottom contact 13, and closes the circuit.

FIG. 3 shows the fused switch arrangement shown in FIG. 2, but with the fuse plug 25 together with the fuse link 20 having been removed from the fused switch unit 10. In order to remove the fuse plug 25 from the fused switch unit, it must be pushed slightly to the left in the figure, in order that the latching element 16 of the fuse plug 25 can be moved over the projection 15 of the housing of the fused switch arrangement.

The locking apparatus 80 is, as already explained in conjunction with FIG. 2, no longer engaged with the fuse plug 25, so that the locking apparatus 80 does not prevent removal of the fuse plug 25 and of the fuse link 20.

Once the fuse plug 25 is no longer pressing downwards onto the protrusion on the blocking element 70, the blocking apparatus 70 is moved upwards in the drawing by means of its spring 71, so that parts of the blocking apparatus 70 extend into an opening 63 in the pushrod 61 of the operating arrangement 60, blocking it.

As is shown in FIG. 4, although the switching lever 40 can be moved to its switched-on position, this results, however, in the switching rod 50 also being pivoted to the switched-on position. The pushrod 61 and the mounting arrangement 60 do not follow the movement of the switching rod 50 since the blocking apparatus 70 is engaged in the opening 63 in the pushrod 61. Since the switching rod 50 and the pushrod 61 are not firmly connected to one another, movement of the switching lever does not exert any force on the pushrod 61 or on the blocking apparatus 70, either. The pushrod 61 and the blocking apparatus 60 are still blocked, so that the switching link 12 is also held at a distance from the bottom contact 13, against the spring force of the spring 62, by the pushrod 61. Thus, as designed, the circuit is still interrupted, as before.

Merely for the sake of completeness, it should be noted that the integral, rigid operating arrangement 60 means that the switching links 12 of the other fused switch units 10 are also held by the corresponding pushrods 61 at a distance from the associated bottom contact 13, even if the fuse plug 25 has not been removed from these fused switch units 10 and the corresponding pushrod 61 is in consequence not autonomously blocked by the separate blocking apparatus 70.

Since the switching rod 50 and the pushrod 61 are not firmly connected to one another this prevents careless operating personnel from being able to cause damage to the fused switch arrangement when the operating arrangement 60 is blocked by one of the blocking apparatuses 70.

Finally, it should be mentioned that, of course, modifications can be carried out to the specific refinements of this embodiment without departing from the subject matter of the invention. In particular, fuse links without fuse plugs can be inserted directly into the fused switch units, and different types of fuse, for example screw-in fuses, may be used instead of plug-in fuses, or a different refinement of the switching lever or of the recess with the dead point may be chosen for switching which is essentially; independent of manual switching.

Furthermore, it should be mentioned that the drawings are only schematic and, in particular, no restrictions with regard to dimensions and sizes can be derived from the drawings.

What is claimed is:

1. A multipole fused switch arrangement for busbar systems having at least two fused switch units (10) which each holds a fuse link (20), with the fused switch units (10) having a mounting and contact apparatus (11) for a busbar (90), and having a switching apparatus for closing and interrupting the circuit of all the switched fuse units (10), wherein the fused switch arrangement comprises a combined switching and blocking apparatus (30), having a switching lever (40) which can be switched to and fro between a switched-on position and a switched-off position, an operating arrangement (60) for switching switching links (12) in the fused switch unit (10), in which case the operating arrangement (60) can switch to and fro between a contact position and an interrupted position, in each case one blocking apparatus (70) for each fused switch unit (10) for blocking the operating arrangement (60) in the interrupted position, and a locking apparatus (80) for locking the fuse links (20) in an operating position, in which case the locking apparatus (80) can be switched to and fro between a locked position and an isolating position, with the locking apparatus (80) being coupled to the switching lever (40) such that it is in the locked position when the switching lever (40) is in the switched-on position, and is in the isolating position when the switching lever (40) is in the switched-off position, with the operating arrangement (60) being coupled to the switching lever (40) such that it is in the interrupted position when the switching lever (40) is in the switched-off position, and with a blocking apparatus (70) blocking the operating arrangement (60) in the interrupted position when one of the fuse links (20) of the associated fused switch arrangement is not in its operating position.

2. The fused switch arrangement as claimed in claim 1, wherein the operating arrangement (60) has a pushrod (61) for each fused switch unit (10), with the pushrods (61) being rigidly connected to one another.

3. The fused switch arrangement as claimed in claim 2, wherein each pushrod (61) rests on the spring-loaded switching links (12).

4. The fused switch arrangement as claimed in claim 1, wherein the operating arrangement (60) is coupled to the switching lever (40) via a switching rod (50).

5. The fused switch arrangement as claimed in claim 4, wherein the switching rod (50) is guided in a recess (41) in the switching lever (40).

6. The fused switch arrangement as claimed in claim 5, wherein the recess (41) has a dead point (42) for switching which is essentially independent of manual switching.

7. The fused switch arrangement as claimed in claim 1, wherein the coupling between the operating arrangement (60) and the switching lever (50) is on one side, and only switching of the switching lever (40) from the switched-on position to the switched-off position results in force being exerted on the operating arrangement (60) in the direction of the interrupted position.

8. The fused switch arrangement as claimed in claim 1, wherein the operating arrangement (60) is prestressed by at least one spring apparatus (62) in its contact position.

9. The fused switch arrangement as claimed in claim 1, wherein each blocking apparatus (70) is prestressed by a spring apparatus (71) in a position which blocks the operating arrangement (60) in its interrupted position.

10. The fused switch arrangement as claimed in claim 9, wherein each blocking apparatus (70) is arranged such that the movement of the associated fuse link (20) to its operating position forces said blocking apparatus (70) against the spring force of the spring apparatus (71) to a position which releases the operating apparatus (60).

11. The fused switched arrangement as claimed in claim 1, wherein, in its blocking position, the blocking apparatus (70) engages in an opening (63) in the operating arrangement (60).

12. The fused switch arrangement as claimed in claim 1, wherein the locking apparatus (80) locks the fuse link (20) directly.

13. The fused switch arrangement as claimed in claim 1, wherein the locking apparatus (80) locks the fuse link (20) indirectly via a fuse plug (25), in which the fuse link (20) is inserted.

14. The fused switch arrangement as claimed in claim 13, wherein the locking apparatus (80) has an interlocking element (82) which, in the interlocked position, engages in a interlocking manner in a latching element (27) on the fuse plug (25).

* * * * *